United States Patent [19]

Kaloi

[11] 3,978,488

[45] Aug. 31, 1976

[54] OFFSET FED ELECTRIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[22] Filed: Apr. 24, 1975

[21] Appl. No.: 571,157

[52] U.S. Cl. ..... 343/829; 343/846; 343/853

[51] Int. Cl.[2] ..... H01Q 1/38

[58] Field of Search ..... 343/846, 854, 829, 853

[56] References Cited

UNITED STATES PATENTS

| | | | |
|---|---|---|---|
| 3,803,623 | 4/1974 | Charlot | 343/846 |
| 3,811,128 | 5/1974 | Munson | 343/854 |

*Primary Examiner*—Eli Lieberman

*Attorney, Agent, or Firm*—Richard S. Sciascia; Joseph M. St.Amand

[57] ABSTRACT

An offset fed electric microstrip dipole antenna consisting of a thin electrically conducting, element formed on one surface of a dielectric substrate, the ground plane being on the opposite surface. The length of the element determines the resonant frequency. The feed point is located along one edge of the antenna length and the input impedance can be varied by moving the feed point along the edge of the antenna to obtain optimum match for the resonant mode without affecting the radiation pattern. The antenna bandwidth increases with the width of the element and spacing between the element and ground plane. Slanting one end of the element will provide a slightly wider bandwidth.

10 Claims, 11 Drawing Figures

OFFSET FED ELECTRIC MICROSTRIP DIPOLE ANTENNA

This invention is related to copending U.S. patent applications:

Ser. No. 571,154 for DIAGONALLY FED ELECTRIC MICROSTRIP DIPOLE ANTENNA;

Ser. No. 571,156 for END FED ELECTRIC MICROSTRIP QUADRUPOLE ANTENNA;

Ser. No. 571,155 for COUPLED FED ELECTRIC MICROSTRIP DIPOLE ANTENNA;

Ser. No. 571,152 for CORNER FED ELECTRIC MICROSTRIP DIPOLE ANTENNA:

Ser. No. 571,153 for NOTCH FED ELECTRIC MICROSTRIP DIPOLE ANTENNA, now U.S. Pat. No. 3,947,850; and Ser. No. 571,158 for ASYMMETRICALLY FED ELECTRIC MICROSTRIP DIPOLE ANTENNA;

all filed together herewith on Apr. 24, 1975 by Cyril M. Kaloi.

BACKGROUND OF THE INVENTION

This invention relates to antennas and more particularly to a low physical profile antenna that can be arrayed to provide near isotropic radiation patterns.

In the past, numerous attempts have been made using stripline antennas to provide an antenna having ruggedness, low physical profile, simplicity, low cost, and conformal arraying capability. However, problems in reproducibility and prohibitive expense made the use of such antennas undesirable. Older type antennas could not be flush mounted on a missile or airfoil surface. Slot type antennas required more cavity space, and standard dipole or monopole antennas could not be flush mounted.

SUMMARY OF THE INVENTION

The present antenna is one of a family of new microstrip antennas. The specific type of microstrip antenna described herein is the "offset fed electric microstrip dipole." This antenna can be arrayed with interconnecting microstrip feedlines as part of the element. Therefore, the antenna element and the feedlines can be photo-etched simultaneously. Using this technique, only one coaxial-to-microstrip adapter is required to interconnect an array of these antennas with a transmitter or receiver.

Reference is made herein to the "electric microstrip dipole" instead of simply the "microstrip dipole" to differentiate between two basic types; the first being the electric microstrip type, and the second being the magnetic microstrip type. The offset fed electric microstrip dipole antenna belongs to the electric microstrip type antenna. The electric microstrip antenna consists essentially of a conducting strip called the radiating element and a conducting ground plane separated by a dielectric substrate. The length of the radiating element is approximately one-half wavelength. The width may be varied depending on the desired electrical characteristics. The conducting ground plane is usually much greater in length and width than the radiating element.

The magnetic microstrip antenna's physical properties are essentially the same as the electric microstrip antenna, except the radiating element is approximately one-fourth the wavelength and also one end of the element is grounded to the ground plane.

The thickness of the dielectric substrate in both the electric and magnetic microstrip antenna should be much less than one-fourth the wavelength. For thickness approaching one-fourth the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since the antenna will tend to operate in a hybrid mode (i.e., microstrip monopole mode) above 25 GHz for most stripline materials commonly used. For clad materials thinner than 0.031 inch, higher frequencies can be used. The design technique used for this antenna provides an antenna with ruggedness, simplicity, low cost, a low physical profile, and conformal arraying capability about the body of a missile or vehicle where used including irregular surfaces while giving excellent radiation coverage. The antenna can be arrayed over an exterior surface without protruding, and be thin enough not to effect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with the aerodynamic design of the missile. In the present type antenna, the antenna element is not grounded to the ground plane. Further, the antenna can be easily matched to most practical impedances by varying the location of the feed point along one edge of the element.

Advantages of the antenna of this invention over other similar appearing types of microstrip antennas is that the present antenna can be fed very easily from the ground plane side and has a slightly wider bandwidth for the same form factor.

The offset fed electric microstrip dipole antenna consists of a thin, electrically-conducting, rectangular-shaped element formed on the surface of a dielectric substrate; the ground plane is on the opposite surface of the dielectric substrate and the microstrip antenna element is fed from a coaxial-to-microstrip adapter, with the center pin of the adapter extending through the ground plane and dielectric substrate to the antenna element. The length of the antenna element determines the resonant frequency. The feed point is located along one edge of the antenna length. While the input impedance will vary as the feed point is moved along the centerline between the antenna center point and the end of the antenna in either direction, the radiation pattern will not be affected by moving the feed point. The antenna bandwidth increases with the width of the element and the spacing (i.e., thickness of dielectric) between the ground plane and the element; the spacing has a somewhat greater effect on the bandwidth than the element width. The radiation pattern changes very little within the bandwidth of operation.

Design equations sufficiently accurate to specify the important design properties of the offset fed electric dipole antenna are also included below. These design properties are the input impedance, the gain, the bandwidth, the efficiency, the polarization, the radiation pattern, and the antenna element dimensions as a function of the frequency. The design equations for this type antenna and the antennas themselves are new.

DESCRIPTION AND OPERATION

Figure 1:
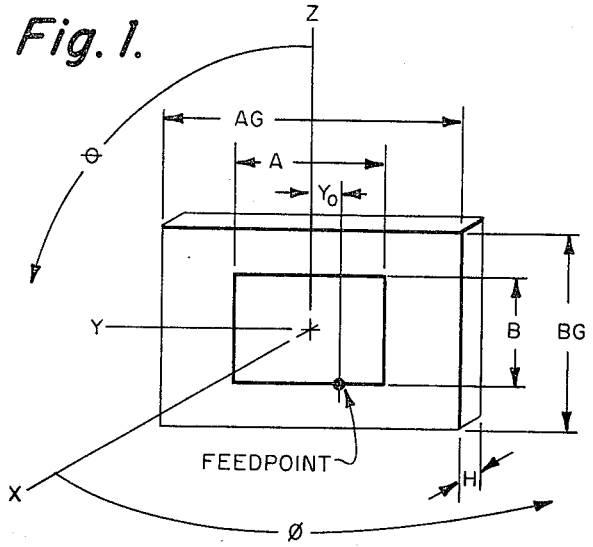
FIG. 1 illustrates the alignment coordinate system used for the offset fed electric microstrip dipole antenna.

The coordinate system used and the alignment of the antenna element within this coordinate system are shown in FIG. 1. The coordinate system is in accordance with the IRIG (Inter-Range Instrumentation Group) Standards and the alignment of the antenna element was made to coincide with the actual antenna patterns that will be shown later. The B dimension is the width or shorter dimension of the antenna element. The A dimension is the length or longer dimension of the antenna element. The A dimension lies along the Y axis in the XY plane and the B dimension lies along the Z axis in the XZ plane as shown in FIG. 1. The H dimension is the height of the antenna element above the ground plane and also the thickness of the dielectric. The AG dimension and the BG dimension are the length and the width of the ground plane, respectively. The $y_o$ dimension is the location of the feed point measured from the center of the antenna element. The angles $\theta$ and $\phi$ are measured per IRIG Standards. The above parameters are measured in inches and degrees.

Figure 2A:
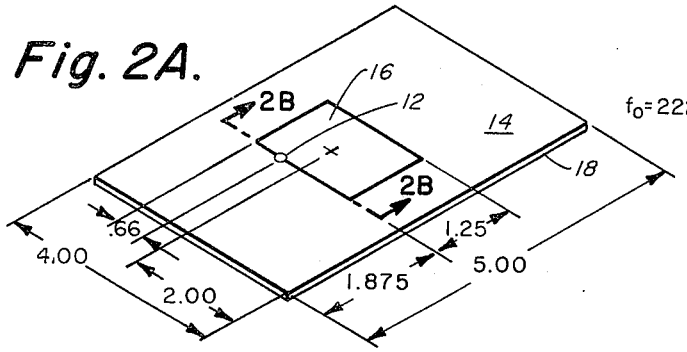
FIG. 2A is an isometric planar view of a typical rectangular offset fed, electric microstrip dipole antenna.
Figure 2B:
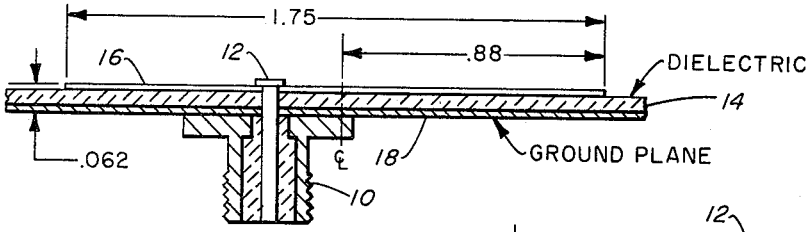
FIG. 2B is a cross-sectional view taken along section line B—B of FIG. 2A.

FIGS. 2A and 2B show a typical offset fed electric microstrip dipole antenna of the present invention. The element can be fed on either edge along the length of the element. If the element width (i.e., B dimension) is less than one-half the element length (i.e., A dimension), the antenna will oscillate in only one resonant mode. For this mode of oscillation, the field is sinusoidal along the length and constant along the width, thereby giving a linear polarization field along the length of the element. If the element width is greater than one-half the element length but less than the element length, the antenna will oscillate in both a resonant mode along the length and also a non-resonant mode along the width. If the width is less than the length, the amount of signal coupled to the non-resonant mode is minimal due to (1) the incoming signal being out of phase with the oscillating signal, therefore having destructive interference between the oscillating signal and the incoming signal; and (2) the mismatch between the signal source and the input impedance to the non-resonant mode. Most of the energy is coupled into the resonant mode, since at resonance the incoming signal is in phase with the oscillating signal and the source resistance is matched to the resonant mode. An optimum match is obtained for the resonant mode by varying the location of the feed point along the edge.

Figure 3:
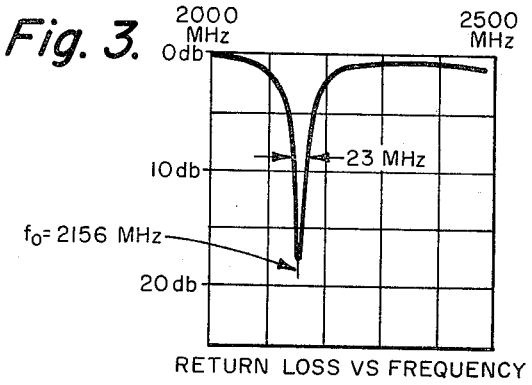
FIG. 3 is a plot showing the return loss versus frequency for an offset antenna element having the dimensions shown in FIGS. 2A and 2B.

FIG. 3 shows a plot of return loss versus frequency, which is an indication of the match for the antenna configuration shown in FIGS. 2A and 2B.

Figure 4B:
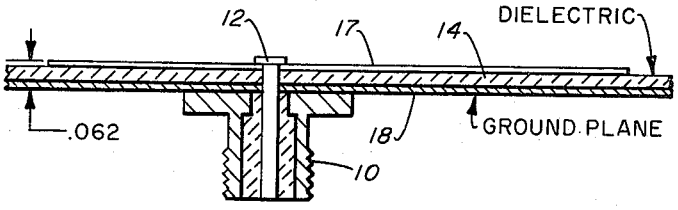
FIG. 4B is a cross-sectional view taken along section line B—B of FIG. 4A.
Figure 4A:
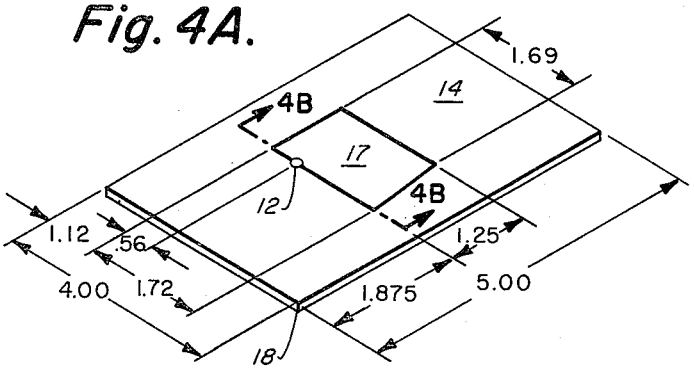
FIG. 4A is an isometric planar view of a typical slanted-end offset fed, electric microstrip dipole antenna.

FIGS. 4A and 4B show an antenna configuration somewhat similar to that shown in FIGS. 2A and 2B. In the case of the antenna of FIGS. 4A and 4B, one of the ends is slanted such that one side along the length is shorter than the other.

Figure 5:
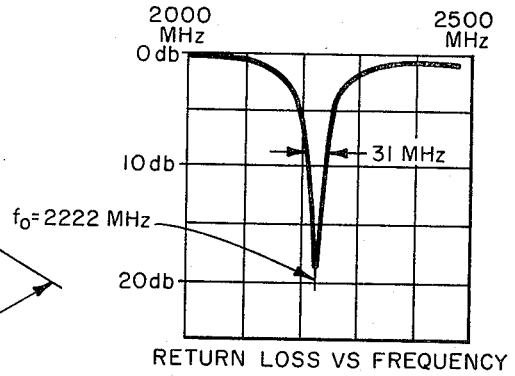
FIG. 5 is a plot showing the return loss versus frequency for an offset antenna element having the dimensions as shown in FIGS. 4A and 4B.
Figure 6:
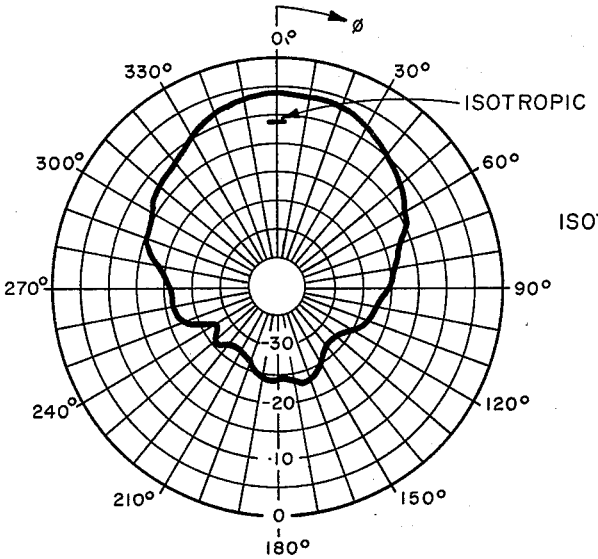
FIG. 6 shows the antenna radiation pattern (XZ-Plane plot) for the square element antenna shown in FIGS. 4A and 4B.
Figure 7:
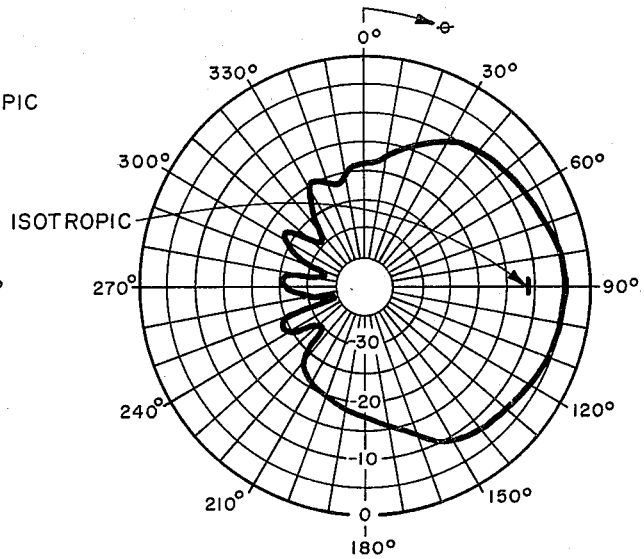
FIG. 7 shows the antenna radiation pattern (XY-Plane plot) for the square element antenna shown in FIGS. 4A and 4B.

The slanted end gives a wider bandwidth and this is shown in the return loss versus frequency plot of FIG. 5. FIGS. 6 and 7 show radiation plots for the XZ-Plane (H-plane) and the XY-Plane (E-plane), respectively, for the antenna configuration of FIGS. 4A and 4B. The radiation plots for the antenna configuration of FIGS. 2A and 2B are very similar to those, of FIG. 4, and therefore are not shown. Cross-polarization radiations due to the non-resonant mode of oscillation is more than 18 db below the radiation due to the resonant mode, and therefore are not shown. The resultant electric field due to the dual mode of oscillation tends to rotate away from the axis along the length. However, for the configurations shown in FIGS. 2A and 2B and FIGS. 4A and 4B, the rotation is very slight. The dual mode of oscillation is not detrimental as far as the performance of the antenna is concerned. If a higher degree of linear polarization is desired, the B dimension should be less than one-half the A dimension.

The two typical antennas are illustrated with the dimensions given in inches, as shown in FIGS. 2A and 2B, and 4A and 4B, by way of example, and the curves shown in later figures are for the typical antennas illustrated. The antenna is fed from a coaxial-to-microstrip adapter 10, with the center pin 12 of the adapter extending through the dielectric substrate 14 and connected to the feed point on the edge of microstrip element 16 or 17. The microstrip antenna can be fed with most of the different types of coaxial-to-microstrip launchers presently available. The dielectric substrate 14 separates the element 16 or 17 from the ground plane 18 electrically.

The copper losses in the clad material determine how narrow the element can be made. The length of the element determines the resonant frequency of the antenna, about which more will be mentioned later. It is preferred that both the length and the width of the ground plane extend at least one wavelength ($\lambda$) in dimension beyond each edge of the antenna element to minimize backlobe radiation.

Figure 8:
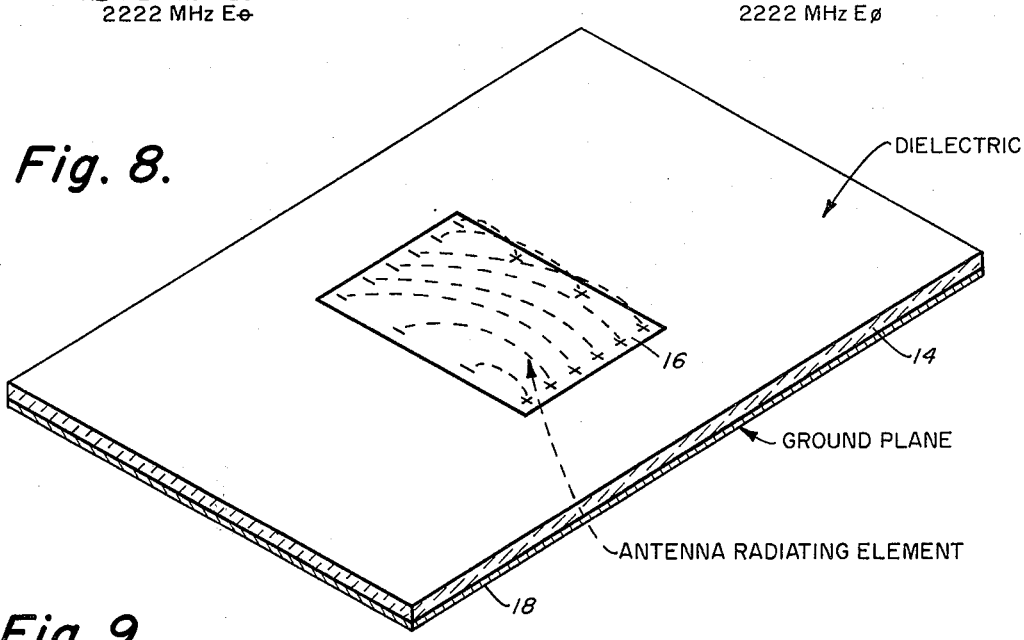
FIG. 8 illustrates the general configuration of the near field radiation when fed along the edge of the antenna element.

A typical near field radiation configuration, when the antenna is fed at the edge of the antenna element, is shown in FIG. 8. The input impedance is affected by the width of the element, the height of the dielectric, the dielectric constant, radiation resistance, etc. If the input impedance deviates from the source impedance, due to reducing the element width, for example, the number of charges along the sides of the element length become smaller as the width becomes smaller and the electric field will become more vertical.

Figure 9:
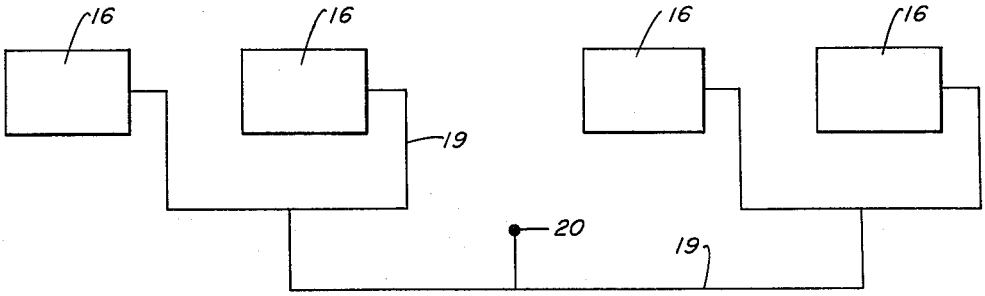
FIG. 9 shows a typical arraying configuration using several antenna elements.

The microstrip antenna elements can be arrayed on a dielectric substrate 14 using microstrip transmission line 19, as diagrammatically illustrated in FIG. 9, using only one coaxial-to-microstrip adapter connection at 20.

Since the design equations for this type of antenna are new, pertinent design equations that are sufficient to characterize this type of antenna are therefore presented.

DESIGN EQUATIONS

To a system designer, the properties of an antenna most often required are the input impedance, gain, bandwidth, efficiency, polarization, and radiation pattern. The antenna designer needs to know the above-mentioned properties and also the antenna element dimension as a function of frequency.

These equations are substantially the same as for the asymmetrically fed electric microstrip dipole antenna disclosed in the aforementioned copending application Ser. No. 571,158. The exact equations for the offset fed microstrip dipole are somewhat more complicated if second order effects due to the non-resonant mode of oscillation are considered. For approximate design equations, one can assume the non-resonant mode of oscillation to be minimum and with this assumption, the following design equations apply:

ANTENNA ELEMENT DIMENSION

The equation for determining the length of the antenna element is given by $$A=\left[1.18\times10^{10}-F\times4\times H\times\sqrt{\epsilon}\right]/\left[2\times F\times\sqrt{1+0.61\times(-\epsilon-1)\times(B/H)^{0.1155}}\right] \quad (1)$$

where $x$ = indicates multiplication $F$ = center frequency (Hz)

$\epsilon$ = the dielectric constant of the substrate (no units.).

In most applications, $B$, $F$, $H$ and $\epsilon$ are usually given. However, it is sometimes desirable to specify $B$ as a function of $A$ as in a square element. As seen from equation (1), a closed form solution is not possible for the square element. However, numerical solution can be accomplished by using Newton's Method of successive approximation (see U.S. National Bureau of Standards, Handbook Mathematical Functions, Applied Mathematics Series 55, Washington, D.C., GPO, Nov. 1964) for solving equation (1) in terms of $B$ when $B$ is a function of $A$. Equation (1) is obtained by fitting curves to Sobol's equation (Sobol, H., "Extending IC Technology to Microwave Equipment," ELECTRONICS, Vol. 40, No. 6, (Mar. 20, 1967), pp. 112–124). The modification was needed to account for end effects when the microstrip transmission line is used as an antenna element. Sobol obtained his equation by fitting curves to Wheeler's conformal mapping analysis (Wheeler, H. "Transmission Line Properties of Parallel Strips Separated by a Dielectric Sheet," IEEE TRANSACTIONS, Microwave Theory Technique, Vol MTT-13, No. 2, March 1965, pp. 172–185).

RADIATION PATTERN

The radiation patterns for the $E_\theta$ field and the $E_\phi$ field are usually power patterns, i.e., $|E_\theta|^2$ and $|E_\phi|^2$, respectively.

The electric field for the offset fed electric dipole is given by $$E_\theta = \frac{jI_m Z_o e^{-jkr}}{2\lambda r}[U\times\cos\phi + T\times\sin\theta] \quad (2)$$

and $$E_\phi = \frac{jI_m Z_o e^{-jkr}}{2\lambda r}[U\times\sin\phi\cos\theta] \quad (3)$$

where $U = (U2 - U3)/U5$ $T = (T3 - T4)/T8$ $U2 = P\sin(A\times P/2)\cos(k\times A\times\sin\theta\sin\phi/2)$ $U3 = k\sin\theta\sin\phi\cos(A\times P/2)\sin(k\times A\times\sin\theta\sin\phi/2)$ $U5 = (P^2 - k^2\sin^2\theta\sin^2\phi)$ $T3 = P\sin(P\times B/2)\cos(k\times B\times\cos\theta/2)$ $T4 = k\cos\theta\cos(P\times B/2)\sin(k\times B\times\cos\theta/2)$ $T8 = (P^2 - k^z\cos^2\theta)$ $\lambda$ = free space wave length (inches)

$\lambda_g$ = waveguide wavelength (inches) and $\lambda_g \approx 2\times A + (4\times H/\sqrt{\epsilon})$ $j = (\sqrt{-1})$ $I_m$ = maximum current (amps)

$$P = \frac{2\pi}{\lambda_g},\ k = \frac{2\pi}{\lambda}$$

$e$ = base of the natural log $r$ = the range between the antenna and an arbitrary point in space (inches)

$Z_o$ = characteristic impedance of the element (ohms) and $Z_o$ is given by $$Z_o = \frac{377\times H}{\sqrt{\epsilon}\times B\times[1+1.735(\epsilon^{-0.0724})(H/B)^{0.836}]}$$

Therefore $$|E_\phi|^2 = \frac{I_m^2 Z_o^2}{4\lambda^2 r^2}[U\times\cos\phi + T\times\sin\theta]^2 \quad (4)$$

and $$|E_\theta|^2 = \frac{I_m^2 Z_o^2}{4\lambda^2 r^2}[U\times\sin\phi\cos\theta]^2 \quad (5)$$

Since the gain of the antenna will be determined later, only relative power amplitude as a function of the aspect angles is necessary. Therefore, the above equations may be written as $$|E_\phi|^2 = \text{Const}\times[U\times\cos\phi + T\times\sin\theta]^2 \quad (6)$$

and $$|E_\theta|^2 = \text{Const}\times[U\times\sin\phi\cos\theta]^2 \quad (7)$$

The above equations for the radiation patterns are approximate since they do not account for the ground plane effects. Instead, it is assumed that the energy emanates from the center and radiates into a hemisphere only. This assumption, although oversimplified, facilitates the calculation of the remaining properties of the antenna. However, a more accurate computation of the radiation pattern can be made.

POLARIZATION

The polarization of the offset fed electric microstrip dipole antenna is linear along the Y axis when the B dimension is less than the A dimension and also when the feed point is located dead center in the B dimension. If the feed point is not located dead center, cross polarizations can occur.

EFFICIENCY

Calculation of the efficiency entails calculating several other properties of the antenna. To begin with, the time average Poynting Vector is given by $$P_{av} = R_e(\overline{E} \times \overline{H}^*)/2 = (|E_\theta|^2 + |E_\phi|^2)/(2 \times Z_o) \quad (8)$$

where

* indicates the complex conjugate when used in the exponent $R_e$ means the real part and $X$ indicates the vector cross product.

$$P_{av} = \frac{Z_o I_m^2}{8\lambda^2 r^2}[U^2 \times \cos^2\phi + 2 \times T \times U \times \sin\theta\cos\phi + T^2 \times \sin^2\theta + U^2 \times \sin^2\phi\cos^2\theta] \quad (9)$$

The radiation intensity, $K$, is the power per unit solid angle radiated in a given direction and is given by $$K = r^2 \times P_{av} \quad (10)$$

The radiated power, $W$, is given by $$W = \int_0^{\pi}\int_{-\frac{\pi}{2}}^{\frac{\pi}{2}} K \times \sin\theta\, d\theta\, d\phi \quad (11)$$

The radiation resistance, $R_a$, is given by $$R_a = \frac{W}{I_{eff}^2} \quad (12)$$

where $$I_{eff} = \frac{I_m}{\sqrt{2}} \quad (13)$$

therefore $$R_a = \frac{2 \times W}{I_m^2} \quad (14)$$

$$R_a = \frac{Z_o}{4 \times \lambda^2}\int_0^{\pi}\int_{-\frac{\pi}{2}}^{\frac{\pi}{2}} [U^2 \times \cos^2\phi + 2 \times T \times U \times \sin\theta\cos\phi + T^2 \times \sin^2\theta + U^2 \times \sin^2\phi\cos^2\theta]\sin\theta\, d\theta\, d\phi \quad (15)$$

Numerical integration of the above equation can be easily accomplished using Simpson's Rule. The efficiency of the antenna can be determined from the ratio of the $Q$ (quality factor) due to the radiation resistance and the $Q$ due to all the losses in the microstrip circuit. The $Q$ due to the radiation resistance, $Q_R$, is given by $$Q_R = (\omega \times L \times A)/(2 \times R_a)$$

where $\omega = 2\pi F$ and $L$ is the inductance of a parallel-plane transmission line and can be found by using Maxwell's Emf equation, where it can be shown that $$L = Z_0/(F \times \lambda_g)$$

and $$\lambda g \approx 2 \times A + (4 \times H/\sqrt{\epsilon})$$

The $Q$ due to the radiation resistance, $Q_R$, is therefore given by $$Q_R = (\pi \times Z_o \times A)/(\lambda_g \times R_a)$$

The $Q$ due to the copper losses, $Q_c$, is similarly determined.

$$Q_c \times (\omega \times L \times A)/(2 \times R_c)$$

where $R_c$ is the equivalent internal resistance of the conductor. Since the ground plane and element are made of copper, the total internal resistance is twice $R_c$. $R_c$ is given by $$R_c = (R_s \times A/B)\ (\text{ohm})$$

where $R_s$ is the surface resistivity and is given by $$R_s = \sqrt{(\pi \times F \times \mu)/\sigma}\ (\text{ohm})$$

where $\sigma$ is the conductivity in mho/in. for copper and $\mu$ is the permeability in henry/in. $\sigma$ and $\mu$ are given by $$\sigma = 0.147 \times 10^7,\ \mu = 0.0319 \times 10^{-6}$$

therefore $$Q_c = (\pi \times Z_o \times_B)/(\lambda g \times R_s)$$

The loss due to the dielectric is usually specified as the loss tangent, $\delta$. The $Q$, resulting from this loss, is given by $$Q_D = 1/\delta$$

The total $Q$ of the microstrip antenna is given by $$Q_T = \frac{1}{\frac{1}{Q_R} + \frac{1}{Q_c} + \frac{1}{Q_D}}$$

The efficiency of the microstrip antenna is given by $$\text{eff} = Q_T/Q_R$$

BANDWIDTH

The bandwidth of the microstrip antenna at the half power point is given by $$\Delta f = F/Q_T$$

The foregoing calculations of $Q$ hold if the height, $H$, of the element above the ground plane is a small part of a waveguide wavelength, $\lambda_g$, where the waveguide wavelength is given by $$\lambda_g \approx 2 \times A + (4 \times H/\sqrt{\epsilon})$$

If $H$ is a significant part of $\lambda_g$, a second mode of radiation known as the monopole mode begins to add to the microstrip mode of radiation. This additional radiation is not undesirable but changes the values of the different antenna parameters.

GAIN

The directive gain is usually defined (H. Jasik, ed., Antenna, Engineering Handbook, New York McGraw-Hill Book Co., Inc., 1961, p.3) as the ratio of the maximum radiation intensity in a given direction to the total power radiated per $4\pi$ steradians and is given by $$D = K_{max}/(W/4\pi)$$

The maximum value of radiation intensity, $K$, occurs when $\theta = 90°$ and $\phi = 0°$. Evaluating $K$ at these values of $\theta$ and $\phi$, we have $$K \Big|_{\substack{\theta = 90° \\ \phi = 0°}} = K_{max}$$

$$K_{max} = \frac{Z_o I_m^2}{8\lambda^2 P^2}[\sin(AP/2) + \sin(BP/2)]^2$$

since $$W = (R_a \times I_m^2)/2$$

$$D = \frac{Z_o \times \pi}{R_a \times \lambda^2 \times P^2}[\sin(AP/2) + \sin(BP/2)]^2$$

and for $A = B$ $$D = (4 \times Z_o \times A^2)/(R_a \times \lambda^2 \times \pi)$$

Typical calculated directive gains are 5.7 db. The gain of the antenna is given by $$G = D \times \text{efficiency}$$

INPUT IMPEDANCE

To determine the input impedance at any point along the offset fed electric microstrip antenna, the current distribution may be assumed to be sinusoidal. Furthermore, at resonance the input reactance at that point is zero. Therefore, the input resistance is given by $$R_{in} = \frac{2 \times Z_o^2 \times \sin^2(2\pi y_o/\lambda_o)}{R_t}$$

Where $R_t$ is the equivalent resistance due to the radiation resistance plus the total internal resistance or $$R_t = R_a + 2R_c$$

The equivalent resistance due to the dielectric losses may be neglected.

The foregoing equations have been developed to explain the performance of the stripline antenna radiators discussed herein and are considered basic and of great importance to the design of antennas in the future.

The offset fed electric microstrip dipole antenna can be made as narrow as the losses, $R_c$, allow it to be, and yet allow it to be fed at the optimum feed point. This permits very narrow strip antennas when needed.

Obviously many modifications and variations of the present invention are possible in light of the above teachings. It is therefore to be understood that within the scope of the appended claims the invention may be practiced otherwise than as specifically described.

I claim:

1. An offset fed electric microstrip dipole antenna having low physical profile and conformal arraying capability, comprising:

a. a thin ground plane conductor;

b. a thin substantially rectangular radiating element spaced from said ground plane;

c. said radiating element being electrically separated from said ground plane by a dielectric substrate;

d. the dimension of said radiating element along the length thereof lies in the E-plane and the dimension of said radiating element along the width thereof lies in the H-plane; the dimension of said radiating element which lies in the H-plane never being greater than the dimension thereof which lies in the E-plane;

e. said radiating element having a feed point located along the edge of the length thereof;

f. said radiating element being fed from a coaxial-to-microstrip adapter, the center pin of said adapter extending through said ground plane and dielectric substrate to said radiating element;

g. the length of said radiating element determining the resonant frequency of said antenna;

the antenna input impedance being variable to match most practical impedances as said feed point is moved along said edge of the length of said antenna radiating element without affecting the antenna radiation pattern;

i. the antenna bandwidth being variable with the width of the radiating element and the spacing between said radiating element and said ground plane, said spacing between the radiating element and the ground plane having somewhat greater effect on the bandwidth than the element width;

j. said radiating element oscillating in only a resonant mode along the length of the element when the element width is less than one-half the element length;

k. said radiating element oscillating in a resonant mode along its length and a non-resonant mode along its width when the element width is greater than one-half the element length; and l. optimum match for the resonant mode of oscillation being obtained by varying the location of said feed point along the element edge.

2. An antenna as in claim 1 wherein the ground plane conductor extends at least one wavelength beyond each edge of the radiating element to minimize any possible backlobe radiation.

3. An antenna as in claim 1 wherein said thin, substantially rectangular radiating element is rectangular except for being slanted at one end thereof, such that along the length thereof one edge is slightly shorter than the other, providing a slightly greater bandwidth.

4. An antenna as in claim 1 wherein a plurality of said radiating elements are arrayed to provide a near isotropic radiation pattern.

5. An antenna as in claim 1 wherein the length of said radiating element is approximately one-half wavelength.

6. An antenna as in claim 1 wherein said thin, substantially rectangular radiating element is exactly rectangular.

7. An antenna as in claim 1 wherein said thin, rectangular radiating element is formed on one surface of said dielectric substrate.

8. A antenna as in claim 1 wherein the length of the antenna radiating element is substantially determined by the equation:

$$A = \left[1.18 \times 10^{10} - F \times 4 \times H \times \sqrt{\epsilon}\right] / \left[2 \times F \times \sqrt{1 + 0.61 \times (\epsilon - 1) \times (B/H)^{0.1155}}\right]$$

where $A$ is the length to be determined $F$ = the center frequency (Hz)

$B$ = the width of the antenna element $H$ = the thickness of the dielectric $\epsilon$ = the dielectric constant of the substrate.

9. An antenna as in claim 1 wherein the radiation patterns are power patterns, $|E_\theta|^2$ and $|E_\phi|^2$, polarization field $E_\phi$ and the field normal to the polarization field $E_\theta$, and are given by the equations:

$$|E_\phi|^2 = \frac{I_m^2 Z_o^2}{4\lambda^2 r^2} [U \times \cos\phi + T \times \sin\theta]^2$$

and $$|E_\theta|^2 = \frac{I_m^2 Z_o^2}{4\lambda^2 r^2} [U \times \sin\phi \cos\theta]^2$$

where $U = (U2 - U3)/U5$ $T = (T3 - T4)/T8$ $U2 = P \sin(A \times P/2)\cos(k \times A \times \sin\theta \sin\phi/2)$ $U3 = k \sin\theta \sin\phi \cos(A \times P/2)\sin(k \times A \times \sin\theta \sin\phi/2)$ $U5 = (P^2 - k^2 \sin^2\theta \sin^2\phi)$ $T3 = P \sin(P \times B/2)\cos(k \times B \times \cos\theta/2)$ $T4 = k \cos\theta \cos(P \times B/2) \sin(k \times B \times \cos\theta/2)$ $T8 = (P^2 - k^2 \cos^2\theta)$ $I_m$ = maximum current (amps)

$$P = \frac{2\pi}{\lambda_g}, \quad k = \frac{2\pi}{\lambda}$$

$\lambda$ = free space wave length (inches)

$\lambda_g$ = waveguide wavelength (inches)

and $\lambda_g \approx 2 \times A + (4 \times H/\sqrt{\epsilon})$ $r$ = the range between the antenna and an arbitrary point in space (inches)

$Z_o$ = characteristic impedance of the element (ohms)

and $Z_o$ is given by $$Z_o = \frac{377 \times H}{\sqrt{\epsilon} \times B \times [1 + 1.735(\epsilon^{-0.0724})(H/B)^{0.830}]}$$

$H$ = the thickness of the dielectric $B$ = the width of the antenna element $\epsilon$ = the dielectric constant of the substrate (no units).

10. An antenna as in claim 1 wherein the minimum width of said radiating element is determined by the equivalent internal resistance of the conductor plus any loss due the dielectric.

* * * * *